US011671733B2

(12) United States Patent
Tsuge

(10) Patent No.: US 11,671,733 B2
(45) Date of Patent: Jun. 6, 2023

(54) SOUND OUTPUT DEVICE

(71) Applicant: MAKITA CORPORATION, Anjo (JP)

(72) Inventor: Kazunori Tsuge, Anjo (JP)

(73) Assignee: MAKITA CORPORATION, Anjo (JP)

( * ) Notice: Subject to any disclaimer, the term of this patent is extended or adjusted under 35 U.S.C. 154(b) by 123 days.

(21) Appl. No.: 17/263,466

(22) PCT Filed: Jun. 20, 2019

(86) PCT No.: PCT/JP2019/024521
§ 371 (c)(1),
(2) Date: Jan. 26, 2021

(87) PCT Pub. No.: WO2020/035995
PCT Pub. Date: Feb. 20, 2020

(65) Prior Publication Data

US 2021/0306725 A1 Sep. 30, 2021

(30) Foreign Application Priority Data

Aug. 17, 2018 (JP) ..... JP2018-153420

(51) Int. Cl.

| | |
|---|---|
| ***H04R 1/02*** | (2006.01) |
| ***H04R 1/26*** | (2006.01) |
| ***H04R 1/28*** | (2006.01) |
| ***H04R 5/02*** | (2006.01) |

(52) U.S. Cl.
CPC ..... *H04R 1/025* (2013.01); *H04R 1/26* (2013.01); *H04R 1/2811* (2013.01); *H04R 5/02* (2013.01); *H04R 2201/028* (2013.01)

(58) Field of Classification Search
CPC .. H04R 1/2811; H04R 5/02; H04R 2201/028; H04R 1/025; H04R 1/26; H04R 1/028; H04R 1/02
See application file for complete search history.

(56) References Cited

U.S. PATENT DOCUMENTS

2005/0225288 A1* 10/2005 Cole ..... H01M 50/247 320/114
2013/0006405 A1 1/2013 Tsuge et al.
2017/0111732 A1 4/2017 Tsuge

FOREIGN PATENT DOCUMENTS

CN 102857244 A 1/2013
CN 205847564 U 12/2016
CN 206353853 U 7/2017
(Continued)

OTHER PUBLICATIONS

Aug. 13, 2019 International Search Report issued in International Patent Application No. PCT/JP2019/024521.
(Continued)

*Primary Examiner* — Kile O Blair
(74) *Attorney, Agent, or Firm* — Oliff PLC

(57) ABSTRACT

A sound output device includes a housing having an internal space, a battery mounting unit on which a battery for an electric tool is mounted, a tweeter at least part of which is disposed in the internal space, a woofer at least part of which is disposed in the internal space, and a partition member that partitions the internal space into a first space in which the tweeter is disposed and a second space in which the woofer is disposed.

14 Claims, 12 Drawing Sheets

(56) References Cited

FOREIGN PATENT DOCUMENTS

| | | | | | |
|---|---|---|---|---|---|
| GB | 2414620 | A | * | 11/2005 | ..... H04R 1/403 |
| JP | S53-043901 | U | | 4/1978 | |
| JP | S60-184391 | U | | 12/1985 | |
| JP | H11-055780 | A | | 2/1999 | |
| JP | 2013-012984 | A | | 1/2013 | |
| JP | 2017-079377 | A | | 4/2017 | |

OTHER PUBLICATIONS

May 10, 2022 Office Action issued in Japanese Patent Application No. 2018-153420.
Sep. 2, 2022 Office Action issued in Chinese Patent Application No. 201980049195.X.

* cited by examiner

SOUND OUTPUT DEVICE

FIELD

The present invention relates to a sound output device.

BACKGROUND

To enjoy music or radio broadcasting at a work site such as an interior finishing work site, a sound output device as disclosed in Patent Literature 1 has been used.

CITATION LIST

Patent Literature

Patent Literature 1: JP 2017-079377 A

SUMMARY

Technical Problem

To improve sound quality of the sound output device, it is conceivable to adopt a multiway speaker system in which sounds are output from each of a tweeter and a woofer. In a case in which the tweeter and the woofer are disposed, vibrations of air caused by a sound output from one speaker of the tweeter and the woofer may hinder a motion of the other speaker. As a result, sound quality may be deteriorated.

An object of an aspect of the present invention is to suppress deterioration of sound quality of a sound output device.

Solution to Problem

According to an aspect of the present invention, a sound output device includes a housing having an internal space; a battery mounting unit on which a battery for an electric tool is mounted; a tweeter at least part of which is disposed in the internal space; a woofer at least part of which is disposed in the internal space; and a partition member that partitions the internal space into a first space in which the tweeter is disposed and a second space in which the woofer is disposed.

Advantageous Effects of Invention

According to an aspect of the present invention, deterioration of sound quality of a sound output device can be suppressed.

DESCRIPTION OF EMBODIMENTS

An embodiment according to the present invention will be described below with reference to the drawings, but the present invention is not limited to the embodiment. Constituent elements of the embodiment described below can be appropriately combined with each other. Part of the constituent elements is not used in some cases.

In the following description, positional relations among respective parts will be described using terms of "front", "rear", "up", "down", "left", and "right". An up-down direction, a left-right direction, and a front-rear direction are orthogonal to each other.

Outline of Sound Output Device

Figure 1:
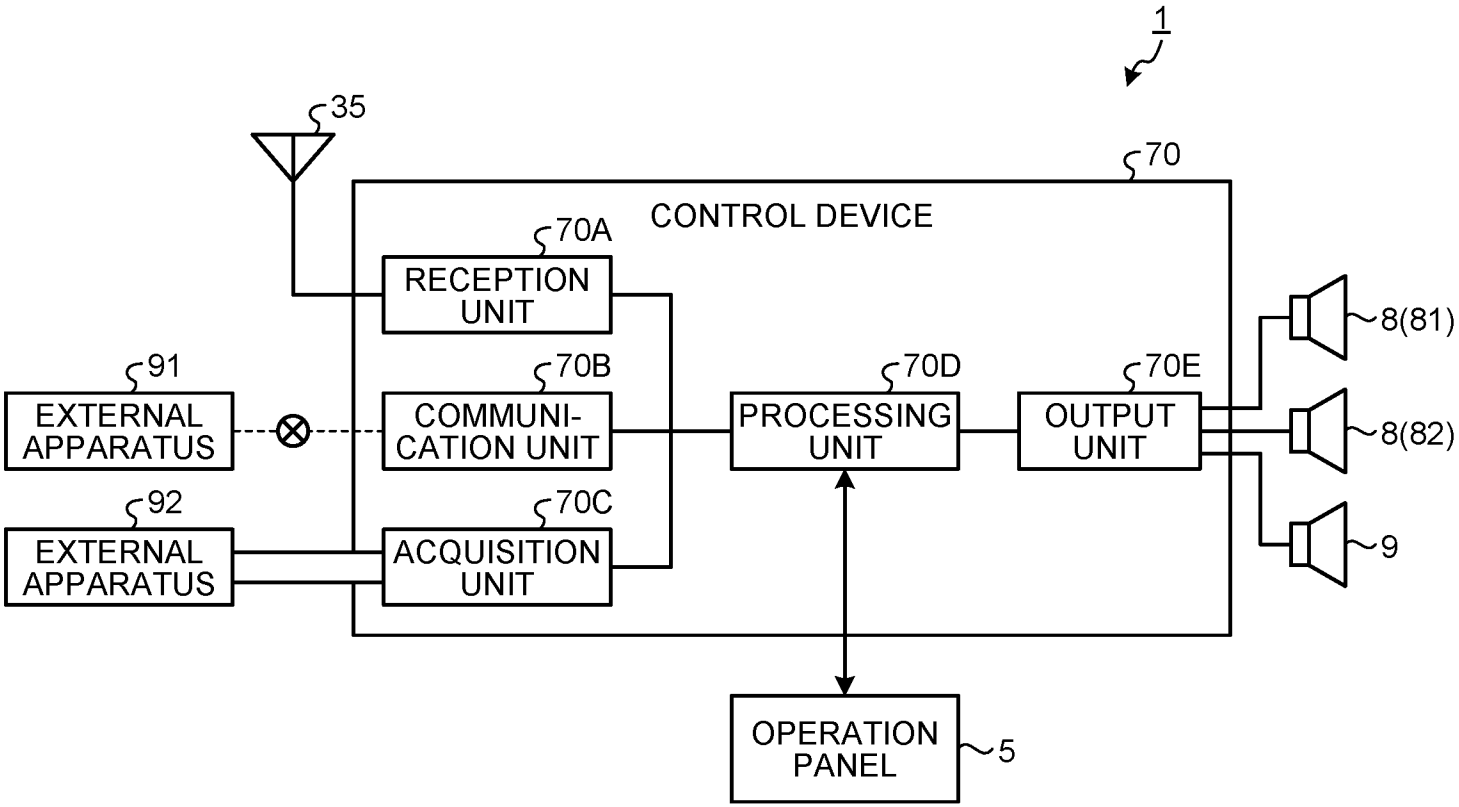
FIG. 1 is a block diagram illustrating an outline of a sound output device according to an embodiment.

FIG. 1 is a block diagram illustrating an outline of a sound output device 1 according to the embodiment. The sound output device 1 has a radio broadcasting output function and a music playback function. The sound output device 1 includes an antenna 35 that receives radio waves of radio broadcasting, tweeters 8, a woofer 9, an operation panel 5, and a control device 70.

The sound output device 1 adopts a multiway speaker system in which each of the tweeters 8 and the woofer 9 outputs sounds. Conceptually, the tweeter 8 encompasses a midrange speaker. The tweeters 8 include a first tweeter 81 and a second tweeter 82.

The control device 70 includes a reception unit 70A, a communication unit 70B, an acquisition unit 70C, a processing unit 70D, and an output unit 70E.

The reception unit 70A functions as a tuner that tunes radio waves of radio broadcasting acquired via the antenna 35 to generate sound data.

The communication unit 70B acquires sound data transmitted from an external apparatus 91 that is different from the sound output device 1. The communication unit 70B communicates with the external apparatus 91 in a wireless manner. The communication unit 70B acquires the sound data transmitted from the external apparatus 91 based on a short-range wireless communication standard such as Bluetooth (registered trademark).

The acquisition unit 70C acquires sound data transmitted from an external apparatus 92 that is different from the sound output device 1. The acquisition unit 70C communicates with the external apparatus 92 in a wired manner. The acquisition unit 70C is connected to the external apparatus 92 via a cable. The acquisition unit 70C acquires the sound data transmitted from the external apparatus 92 via the cable.

The processing unit 70D processes at least one of the sound data generated by the reception unit 70A, the sound data acquired by the communication unit 70B, and the sound data acquired by the acquisition unit 70C. The processing unit 70D processes the sound data based on operation data that is generated when the operation panel 5 is operated, for example. Processing of the sound data includes adjustment processing for sound volume and adjustment processing for sound quality. The adjustment processing for sound quality includes adjustment of a frequency characteristic of a sound.

The output unit 70E amplifies the sound data processed by the processing unit 70D to be output to the tweeters 8 and the woofer 9. The tweeters 8 and the woofer 9 output sounds based on the sound data output from the output unit 70E.

Sound Output Device

Figure 2:
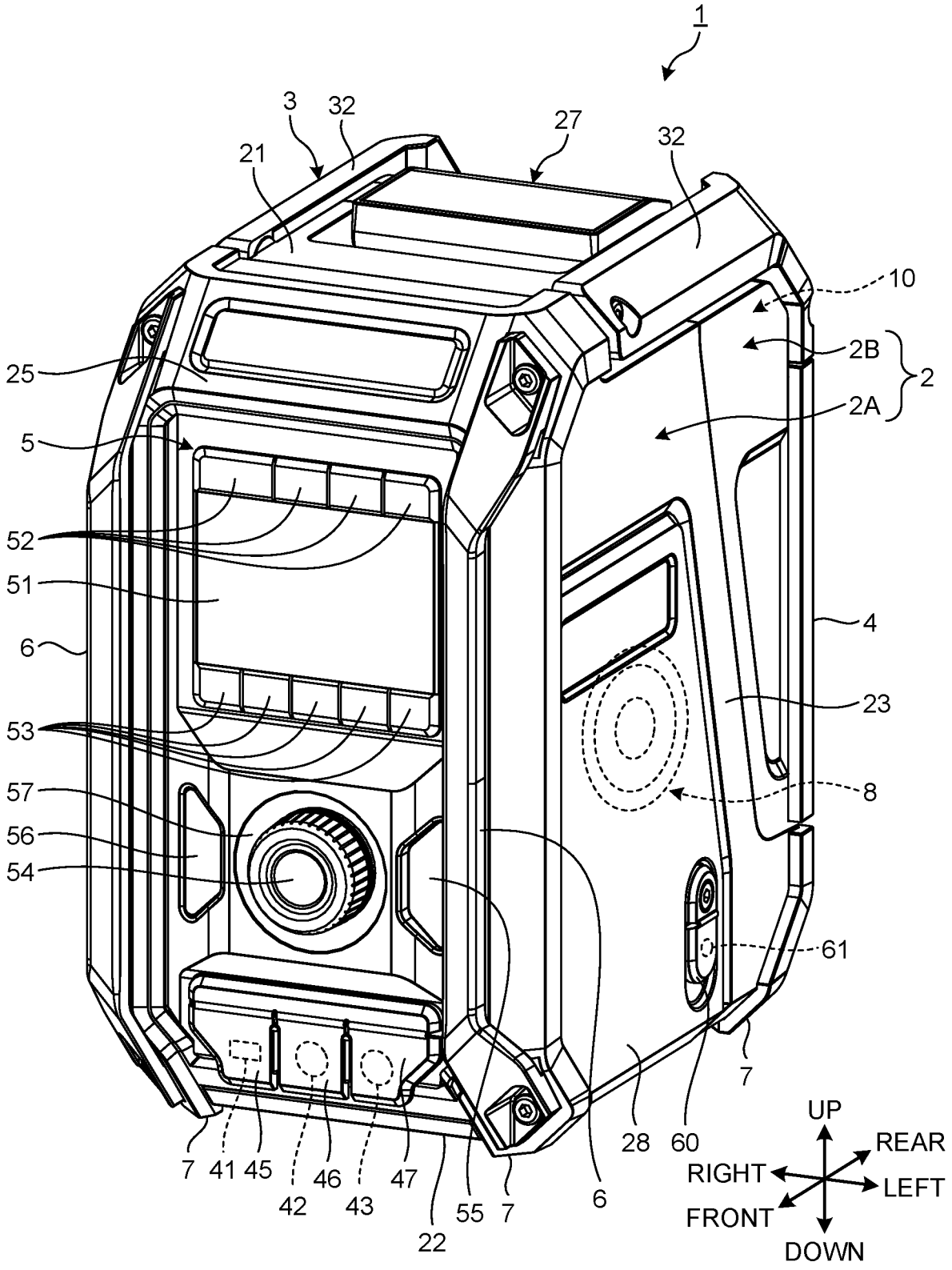
FIG. 2 is a perspective view illustrating the sound output device according to the embodiment.
Figure 3:
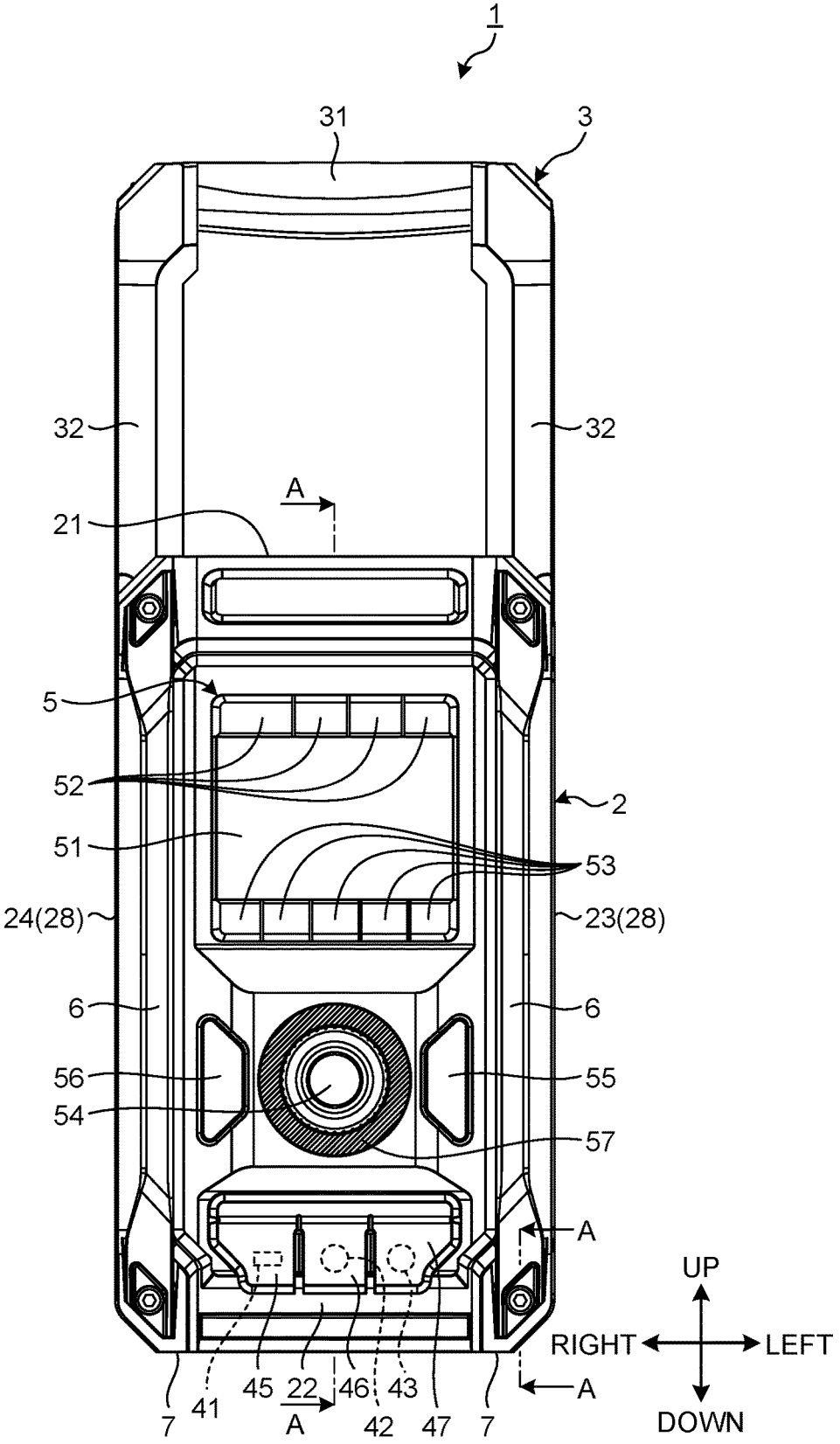
FIG. 3 is a front view illustrating the sound output device according to the embodiment.
Figure 4:
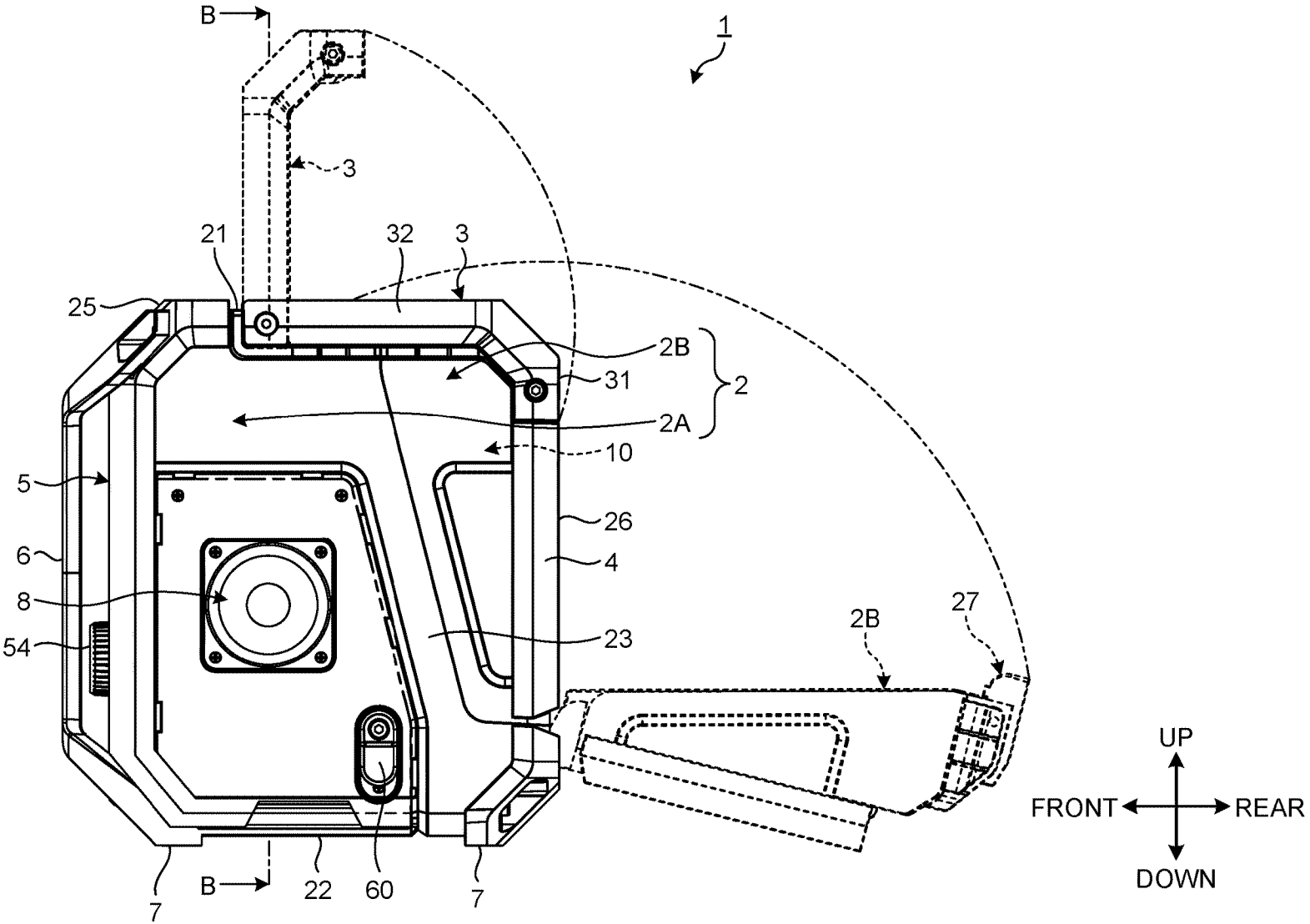
FIG. 4 is a side view illustrating the sound output device according to the embodiment.
Figure 5:
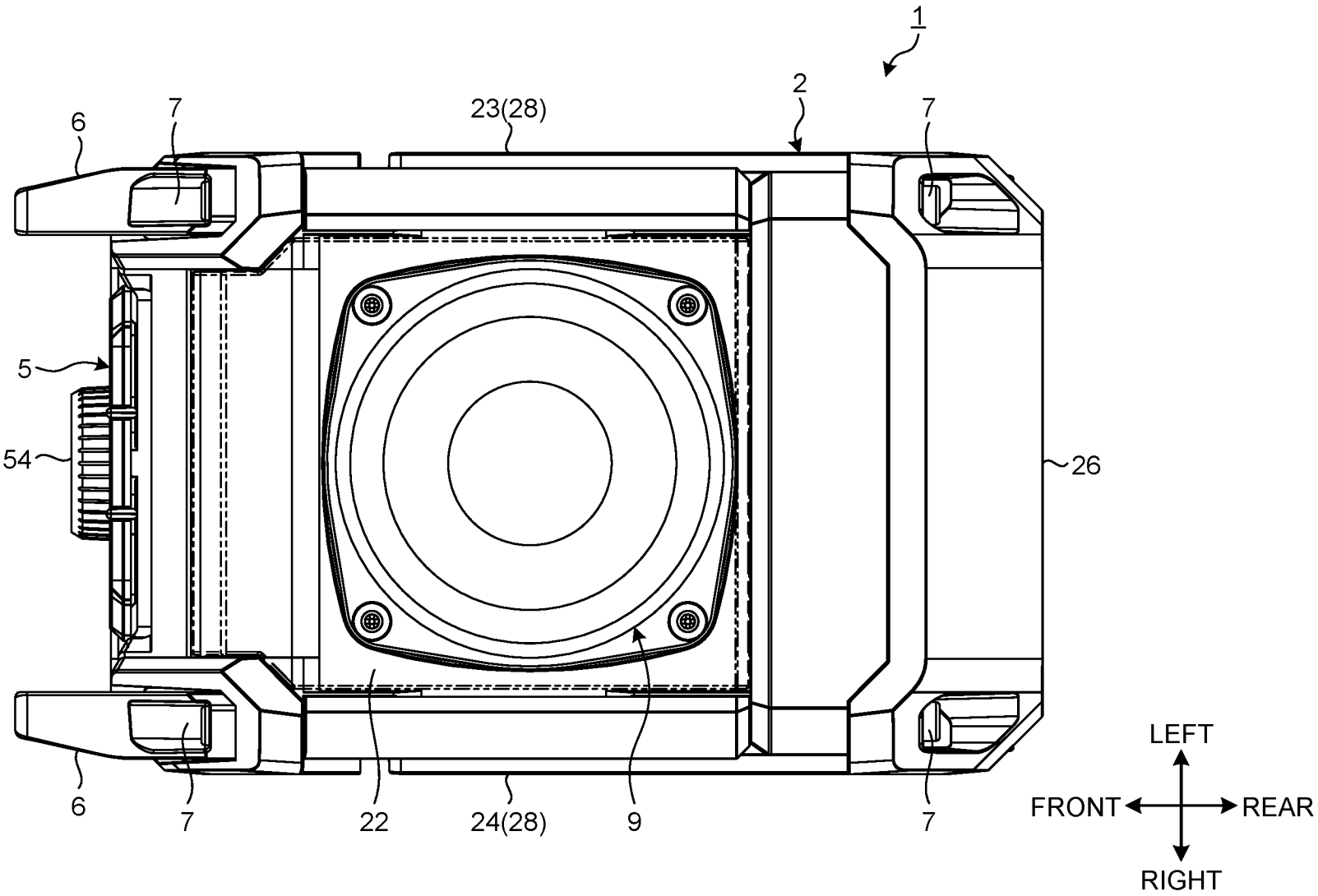
FIG. 5 is a bottom view illustrating the sound output device according to the embodiment.

FIG. 2 is a perspective view illustrating the sound output device 1 according to the embodiment. FIG. 3 is a front view illustrating the sound output device 1 according to the embodiment. FIG. 4 is a side view illustrating the sound output device 1 according to the embodiment. FIG. 5 is a bottom view illustrating the sound output device 1 according to the embodiment.

As illustrated in FIG. 2, FIG. 3, FIG. 4, and FIG. 5, the sound output device 1 includes a housing 2, a handle 3, a buffer member 4, the operation panel 5, guard members 6, leg parts 7, the tweeters 8, the woofer 9, and a battery housing chamber 10.

An external shape of the housing 2 is a substantially rectangular parallelepiped shape. The housing 2 includes an upper plate 21, a lower plate 22, a left plate 23, a right plate 24, a front plate 25, and a rear plate 26.

The housing 2 includes a main body member 2A and a lid member 2B. The battery housing chamber 10 is defined between the main body member 2A and the lid member 2B. The main body member 2A includes a front part of the upper plate 21, the lower plate 22, a front part of the left plate 23, a front part of the right plate 24, and the front plate 25. The lid member 2B includes a rear part of the upper plate 21, a rear part of the left plate 23, a rear part of the right plate 24, and the rear plate 26.

As illustrated in FIG. 4, a lower end part of the lid member 2B is coupled to the main body member 2A in a rotatable manner. A lock mechanism 27 is disposed on the lid member 2B to be coupled to the main body member 2A in a detachable manner. The lock mechanism 27 includes a latch mechanism. A pivot shaft of the lid member 2B extends in the left-right direction. When the lid member 2B rotates, the battery housing chamber 10 is opened or closed.

The handle 3 is held by an operator. The handle 3 is coupled to the main body member 2A in a rotatable manner. The operator can carry the sound output device 1 in a state of holding the handle 3. The handle 3 includes a holding part 31 to be held by the operator, and arm parts 32 that couple the holding part 31 with the main body member 2A. The arm parts 32 include a first arm part 32 coupled to a left part of the upper plate 21, and a second arm part 32 coupled to a right part of the upper plate 21. The arm parts 32 are coupled to the main body member 2A in a rotatable manner. A pivot shaft of the arm part 32 extends in the left-right direction. The holding part 31 extends in the left-right direction to connect the first arm part 32 with the second arm part 32. As illustrated in FIG. 4, the handle 3 rotates to shift from a stored state to an erected state and vice-versa. As represented by a solid line in FIG. 4, the stored state means a state in which the arm part 32 substantially extends in the front-rear direction, and is in contact with the upper plate 21. As represented by a dotted line in FIG. 4, the erected state means a state in which the arm parts 32 substantially extend in the up-down direction, and are separated from the upper plate 21. The handle 3 can rotate by about 90° between the stored state and the erected state. In the stored state, an upper surface of the upper plate 21 and an upper surface of the handle 3 are disposed on substantially the same plane, and a rear surface of the rear plate 26 and a rear surface of the handle 3 are disposed on substantially the same plane.

The buffer member 4 absorbs shocks to protect the housing 2. The buffer member 4 is disposed at a corner part of the housing 2. The buffer member 4 is made of an elastomer, for example.

The operation panel 5 is disposed on the front plate 25 of the housing 2. The operation panel 5 includes a display device 51, a plurality of buttons 52 that are disposed on an upper side of the display device 51, a plurality of buttons 53 that are disposed on a lower side of the display device 51, a dial 54 that is disposed on a lower side of the buttons 53, an equalizer button 55 that is disposed on a left side of the dial 54, an info button 56 that is disposed on a right side of the dial 54, and a light emitting unit 57 that is disposed around the dial 54.

The display device 51 includes a flat panel display such as a liquid crystal display (LCD). The display device 51 displays display data indicating a working state of the sound output device 1.

The buttons 52 include a power supply button that is operated to switch between ON and OFF of a power supply of the sound output device 1, a radio switching button that is operated to switch radio broadcasting to be received between Amplitude Modulation (AM) broadcasting and Frequency Modulation (FM) broadcasting, an alarm setting button that is operated to set an output time of an alarm, and the like.

The buttons 53 include a preset button that is operated to select a radio broadcasting station, a pairing button that is operated to make wireless communication between the external apparatus 91 and the communication unit 70B, and the like.

The dial 54 is operated to select a radio broadcasting station, and to adjust sound volume output from the tweeters 8 and the woofer 9.

The equalizer button 55 is operated to change a mode indicating frequency characteristics of sounds output from the tweeters 8 and the woofer 9. A plurality of types of modes are registered in the processing unit 70D in advance. The mode is changed every time the equalizer button 55 is operated. The operator may operate the operation panel 5 to register an optional mode in the processing unit 70D. The operator can set the mode appropriate for a type of music to be played by operating the equalizer button 55. As the modes, exemplified are a flat mode indicating a standard frequency characteristic, a jazz mode appropriate for jazz music, a rock mode appropriate for rock music, a classic mode appropriate for classic music, a pop mode appropriate for popular music, a news mode appropriate for radio broadcasting, and a my equalizer mode that is set by the operator.

The info button 56 is operated for time setting of a clock display function of the operation panel 5, for example.

The light emitting unit 57 includes a light source such as a light emitting diode (LED). The light source includes a red light emitting diode that can emit red light, a green light emitting diode that can emit green light, and a blue light emitting diode that can emit blue light. That is, the light emitting unit 57 can emit light of a plurality of colors. The light emitting unit 57 emits light of a specific color based on a mode set by the equalizer button 55. By way of example, in a case in which the flat mode is set, the light emitting unit 57 emits white light. In a case in which the jazz mode is set, the light emitting unit 57 emits blue light. In a case in which the rock mode is set, the light emitting unit 57 emits red light. In a case in which the classic mode is set, the light emitting unit 57 emits brown light. In a case in which the pop mode is set, the light emitting unit 57 emits pink light.

In a case in which the news mode is set, the light emitting unit 57 emits yellow light. In a case in which the my equalizer mode is set, the light emitting unit 57 emits green light. When colored light emitted from the light emitting unit 57 is changed based on the set mode, the operator can intuitively recognize the set mode.

The guard member 6 is a protecting member that protects the operation panel 5. The guard member 6 projects forward from the operation panel 5 from each of a left part and a right part of the front plate 25. Each of an upper part and a lower part of the guard member 6 is coupled to the housing 2. An intermediate part of the guard member 6 is separated from the housing 2.

The leg parts 7 are respectively disposed at four corner parts of a lower surface of the lower plate 22. The leg part 7 projects downward from the lower surface of the lower plate 22. In a case of disposing the sound output device 1 on a disposition surface such as a floor surface, the operator disposes the sound output device 1 to bring the leg parts 7 into contact with the disposition surface. In a state in which the leg parts 7 are in contact with the disposition surface, the lower surface of the lower plate 22 is separated from the disposition surface.

The sound output device 1 also includes a first terminal 41, a second terminal 42, and a third terminal 43 that are disposed on a lower part of the front plate 25. The first terminal 41 is a Universal Serial Bus (USB) terminal. The second terminal 42 is a microphone jack. When a microphone is connected to the second terminal 42, a sound input through the microphone is amplified and output from each of the tweeters 8 and the woofer 9. The third terminal 43 is an auxiliary (AUX) terminal. The first terminal 41 is covered by a cover 45. The second terminal 42 is covered by a cover 46. The third terminal 43 is covered by a cover 47.

The sound output device 1 further includes a power supply terminal 61 disposed on a lower part of the left plate 23. The power supply terminal 61 is connected to an AC power supply (commercial power supply) via an alternating current (AC) adapter. The AC adapter converts AC power supplied from the AC power supply into DC power to be output to the power supply terminal 61. The power supply terminal 61 is covered by a cover 60.

Tweeter and Woofer

Figure 6:
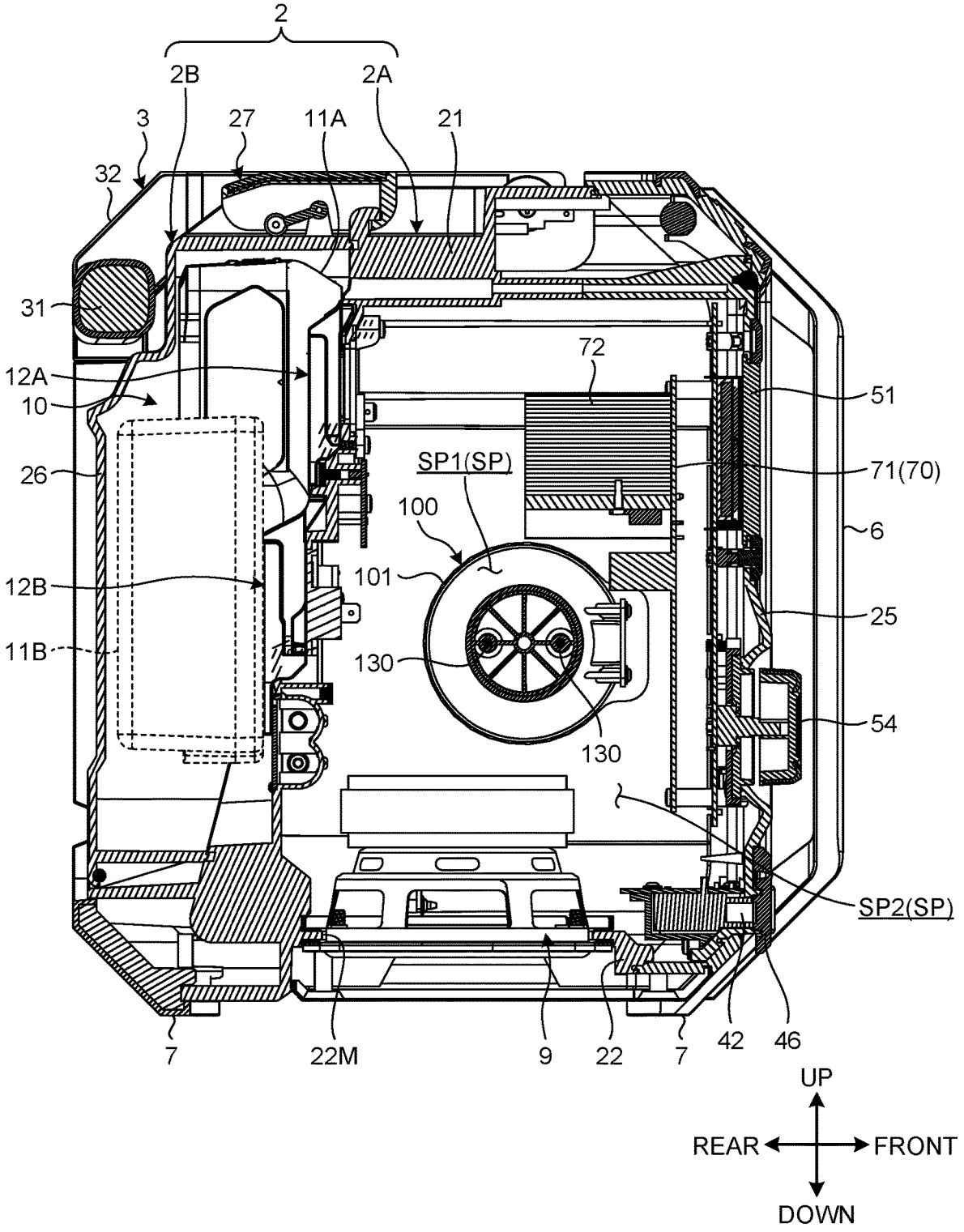
FIG. 6 is a cross-sectional view illustrating the sound output device according to the embodiment.
Figure 7:
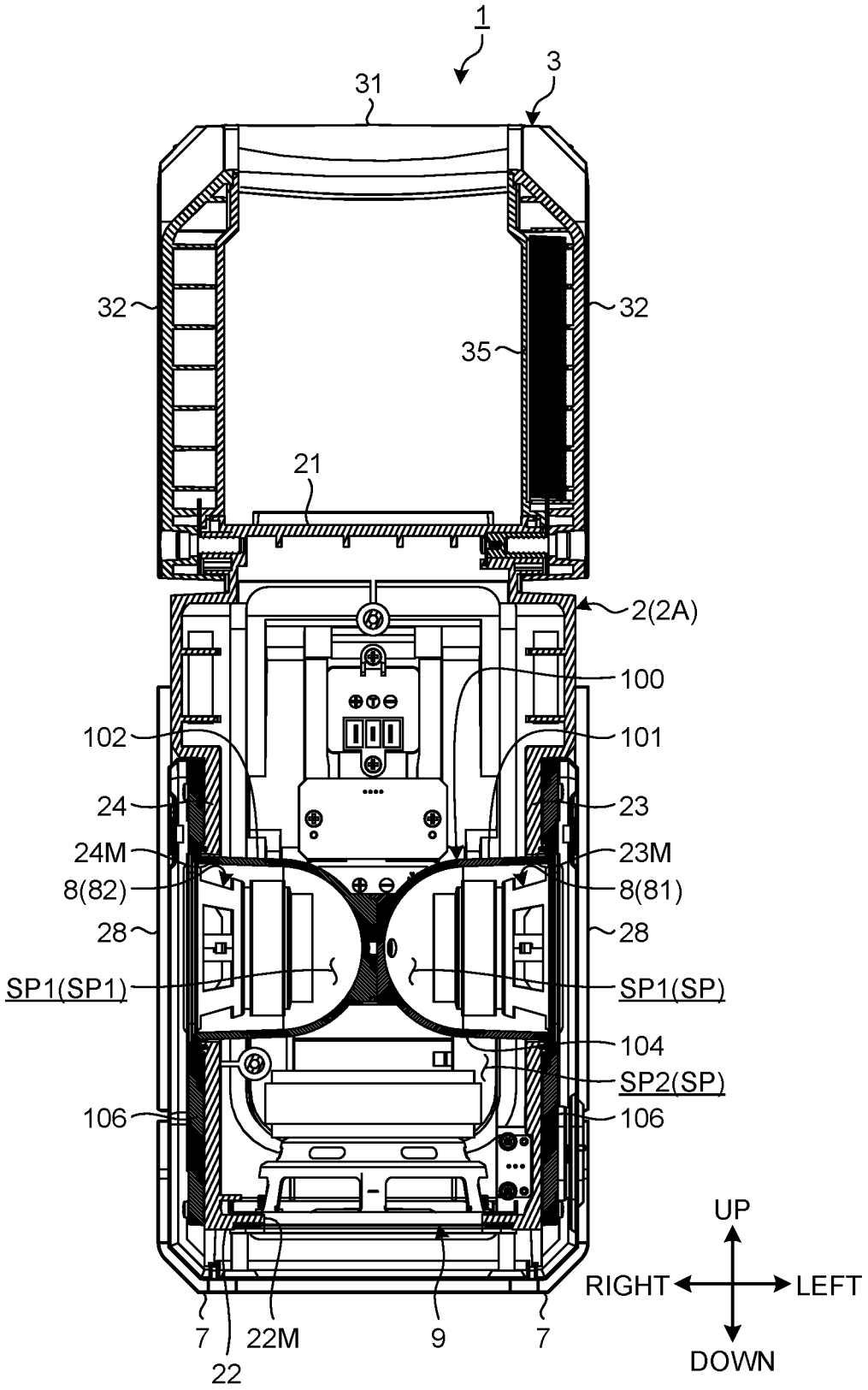
FIG. 7 is a cross-sectional view illustrating the sound output device according to the embodiment.

FIG. 6 is a cross-sectional view illustrating the sound output device 1 according to the embodiment. FIG. 6 illustrates a view taken along the A-A line of FIG. 3. FIG. 7 is a cross-sectional view illustrating the sound output device 1 according to the embodiment. FIG. 7 illustrates a view taken along the B-B line of FIG. 4.

As illustrated in FIG. 6 and FIG. 7, the housing 2 has an internal space SP. At least part of the tweeters 8 is disposed in the internal space SP. At least part of the woofer 9 is disposed in the internal space SP.

In the present embodiment, the sound output device 1 includes a partition member 100 that partitions the internal space SP into a first space SP1 in which the tweeter 8 is disposed and a second space SP2 in which the woofer 9 is disposed. The partition member 100 is disposed around the tweeter 8 in the internal space SP. The partition member 100 may be made of a synthetic resin, or may be made of metal.

In the present embodiment, the sound output device 1 includes the two tweeters 8. The tweeters 8 include a first tweeter 81 disposed on the left plate 23 of the housing 2, and a second tweeter 82 disposed on the right plate 24 of the housing 2. A structure and a size of the first tweeter 81 are the same as a structure and a size of the second tweeter 82. A center position of the first tweeter 81 coincides with a center position of the second tweeter 82 in each of the up-down direction, and the front-rear direction. The first tweeter 81 outputs a sound toward the left side of the left plate 23. The second tweeter 82 outputs a sound toward the right side of the right plate 24.

The woofer 9 is disposed on the lower plate 22 of the housing 2. In the left-right direction, the woofer 9 is disposed between the first tweeter 81 and the second tweeter 82. A center position of the housing 2 coincides with a center position of the woofer 9 in the left-right direction. The woofer 9 outputs a sound toward a side lower than the lower plate 22.

In at least one of the up-down direction and the front-rear direction, the center position of the first tweeter 81 does not necessarily coincides with the center position of the second tweeter 82.

In the left-right direction, the center position of the housing 2 does not necessarily coincides with the center position of the woofer 9.

In the front-rear direction, the center position of the tweeter 8 may coincide or does not necessarily coincide with the center position of the woofer 9.

The housing 2 has an opening that connects the internal space SP with an external space of the housing 2. The opening of the housing 2 has an opening 22M provided in the lower plate 22, an opening 23M provided in the left plate 23, and an opening 24M provided in the right plate 24. At least part of the woofer 9 is disposed inside the opening 22M. At least part of the first tweeter 81 is disposed inside the opening 23M. At least part of the second tweeter 82 is disposed inside the opening 24M.

At least part of the partition member 100 is disposed in the opening 23M, and at least part of the partition member 100 is disposed in the opening 24M. The partition member 100 is supported by the housing 2. At least part of the tweeter 8 is connected to the partition member 100. The tweeter 8 is supported by the housing 2 via the partition member 100.

The partition member 100 includes a first partition member 101 that is disposed around the first tweeter 81 and supported by the left plate 23 of the housing 2, and a second partition member 102 that is disposed around the second tweeter 82 and supported by the right plate 24 of the housing 2. In the internal space SP, the first partition member 101 is connected with the second partition member 102. As illustrated in FIG. 6, the first partition member 101 is connected with the second partition member 102 via fixing members 130 such as screws.

Figure 8:
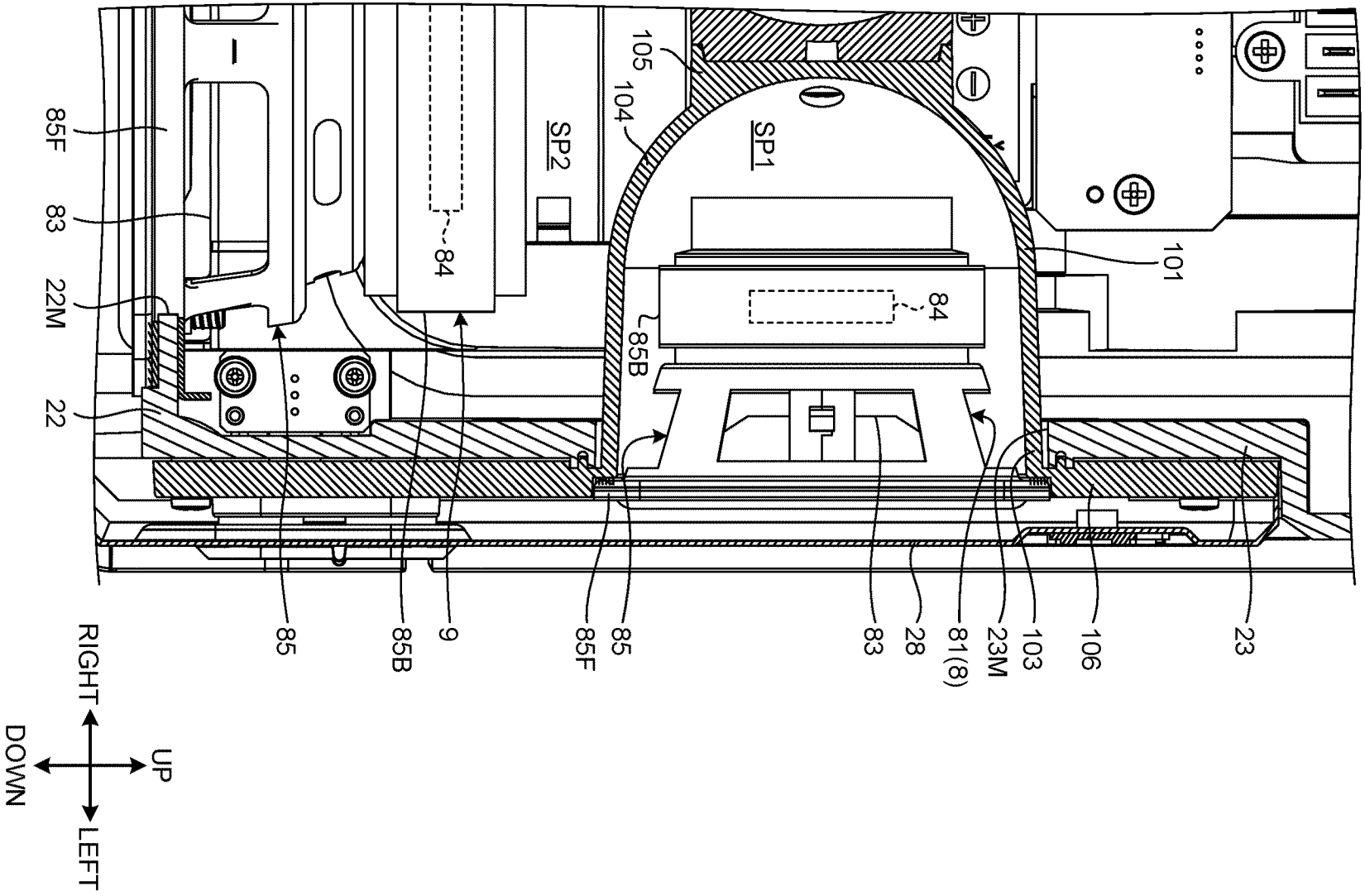
FIG. 8 is an enlarged view of part of FIG. 7.

FIG. 8 is an enlarged view of part of FIG. 7. The first tweeter 81 and the second tweeter 82 have equivalent structures and sizes, and the first partition member 101 and the second partition member 102 have equivalent structures and sizes. The following mainly describes the first tweeter 81 and the first partition member 101, and description about the second tweeter 82 and the second partition member 102 is simplified or omitted.

The first tweeter 81 includes a diaphragm 83, a coil 84, and a frame 85. The frame 85 includes a flange part 85F that supports the diaphragm 83, and a main body part 85B disposed around the coil 84. The main body part 85B of the frame 85 supports at least the coil 84 and a magnet.

The first partition member 101 includes a rim part 103 disposed in the opening 23M, a bowl part 104 that is disposed in the internal space SP and forms the first space SP1, and a base part 105. The rim part 103 supports the flange part 85F. At least part of the rim part 103 is disposed around the flange part 85F. The bowl part 104 is disposed around the main body part 85B. The first space SP1 is a space inside the bowl part 104.

The bowl part 104 is a cup-shaped member. The rim part 103 includes an opening edge of the bowl part 104. The rim part 103 opens toward the left side. The base part 105 is fixed to a right part of the bowl part 104. An inner surface of the bowl part 104 facing the first space SP1 includes a curved surface. An outer surface of the bowl part 104 facing the second space SP2 includes a curved surface. The first space SP1 formed by the bowl part 104 is substantially sealed.

The first partition member 101 further includes a plate part 106. The plate part 106 is disposed around the rim part 103. The plate part 106 is fixed to the rim part 103. In the present embodiment, at least part of the plate part 106 is disposed around the flange part 85F. The plate part 106 is disposed to face a left surface (outer surface) of the left plate 23. That is, the plate part 106 is disposed on the left side (outer side) of the left plate 23 with respect to the center of the housing 2 in the left-right direction. A mesh plate 28 is disposed to face the plate part 106. The mesh plate 28 is a plate made of metal having a large number of small holes. The mesh plate 28 is disposed to cover the first tweeter 81.

FIG. 2, FIG. 3, and FIG. 5 illustrate a state in which the mesh plate 28 is connected to the housing 2, and FIG. 4 illustrates a state in which the mesh plate 28 is removed from the housing 2.

Similarly to the first partition member 101, the second partition member 102 includes the rim part 103, the bowl part 104, the base part 105, and the plate part 106. The rim part 103 of the second partition member 102 opens toward the right side. The base part 105 of the second partition member 102 is fixed to a left part of the bowl part 104 of the second partition member 102. The plate part 106 of the second partition member 102 is disposed on the right side (outer side) of the right plate 24 with respect to the center of the housing 2 in the left-right direction. The mesh plate 28 is disposed to face the plate part 106 of the second partition member 102. The mesh plate 28 is disposed to cover the second tweeter 82.

The base part 105 of the first partition member 101 is connected with the base part 105 of the second partition member 102 via the fixing members 130.

Similarly to the tweeter 8, the woofer 9 includes the diaphragm 83, the coil 84, and the frame 85. The frame 85 includes the flange part 85F supporting the diaphragm 83, and the main body part 85B disposed around the coil 84. The flange part 85F of the woofer 9 is disposed in the opening 22M of the lower plate 22. The woofer 9 is supported by the lower plate 22 of the housing 2.

The woofer 9 outputs a sound toward a side lower than the lower plate 22. In the present embodiment, the leg parts 7 are disposed on part of the periphery of the woofer 9. In a state in which the leg parts 7 are in contact with the disposition surface, the lower surface of the lower plate 22 and the woofer 9 are separated from the disposition surface.

As illustrated in FIG. 6, a control board 71 that functions as at least part of the control device 70 is disposed in the internal space SP of the housing 2. A heat sink 72 for cooling the control board 71 is connected to the control board 71.

As illustrated in FIG. 7, the antenna 35 that receives radio waves of radio broadcasting is disposed in an inner part of the arm part 32 of the handle 3. When the handle 3 is caused to be in the erected state, the antenna 35 is also caused to be in the erected state. For example, in a case in which the antenna 35 is an FM antenna that receives radio waves of FM broadcasting, the operator causes the handle 3 to be in the erected state to listen to the FM broadcasting. When the operator does not listen to the FM broadcasting, the operator causes the handle 3 to be in the stored state. In the stored state, the upper surface of the upper plate 21 and the upper surface of the handle 3 are disposed on substantially the same plane, and the rear surface of the rear plate 26 and the rear surface of the handle 3 are disposed on substantially the same plane. In this way, the antenna 35 is incorporated in the arm part 32, so that design of the sound output device 1 is improved.

Battery Housing Chamber

Figure 9:
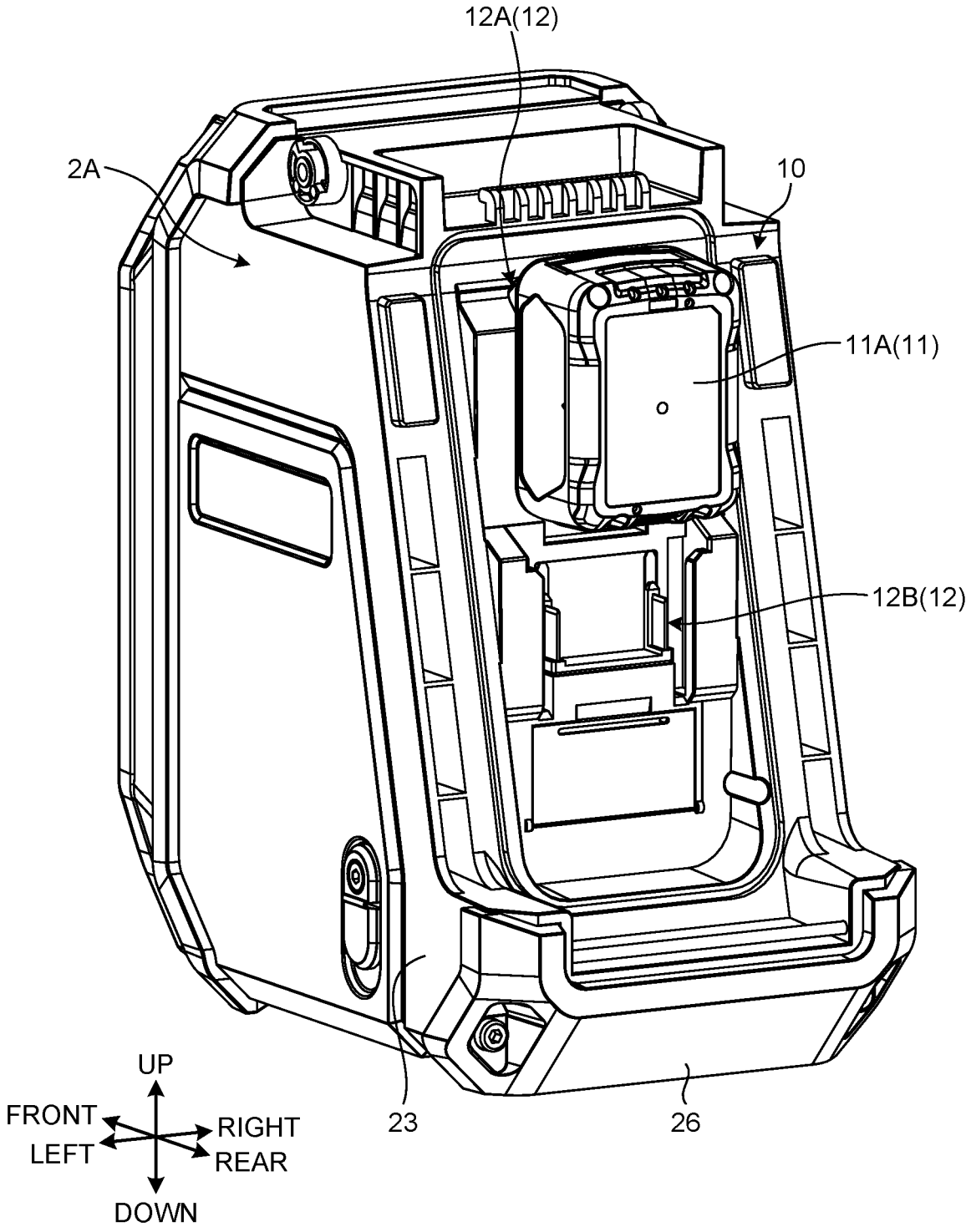
FIG. 9 is a perspective view illustrating a battery housing chamber according to the embodiment.
Figure 10:
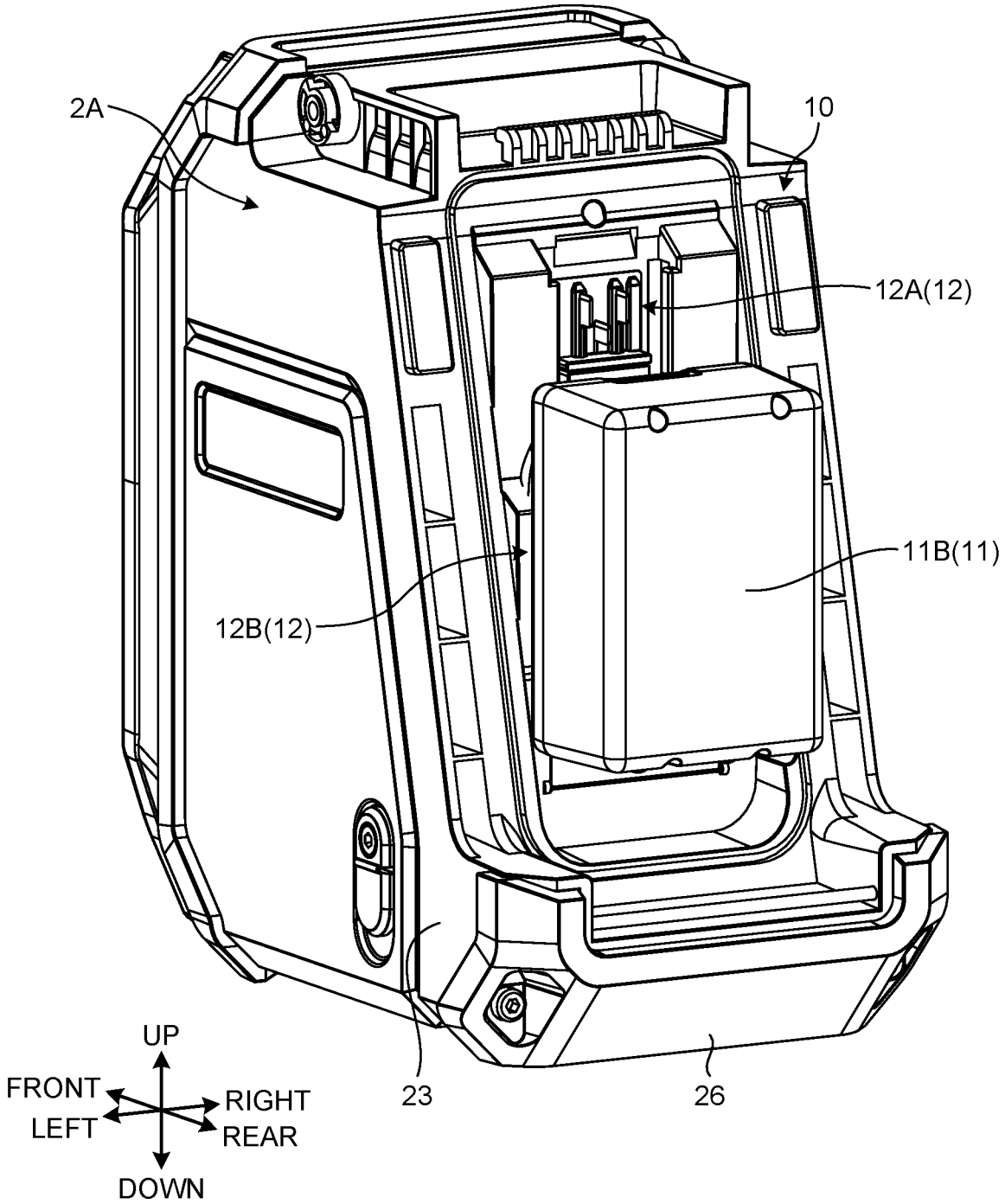
FIG. 10 is a perspective view illustrating the battery housing chamber according to the embodiment.
Figure 11:
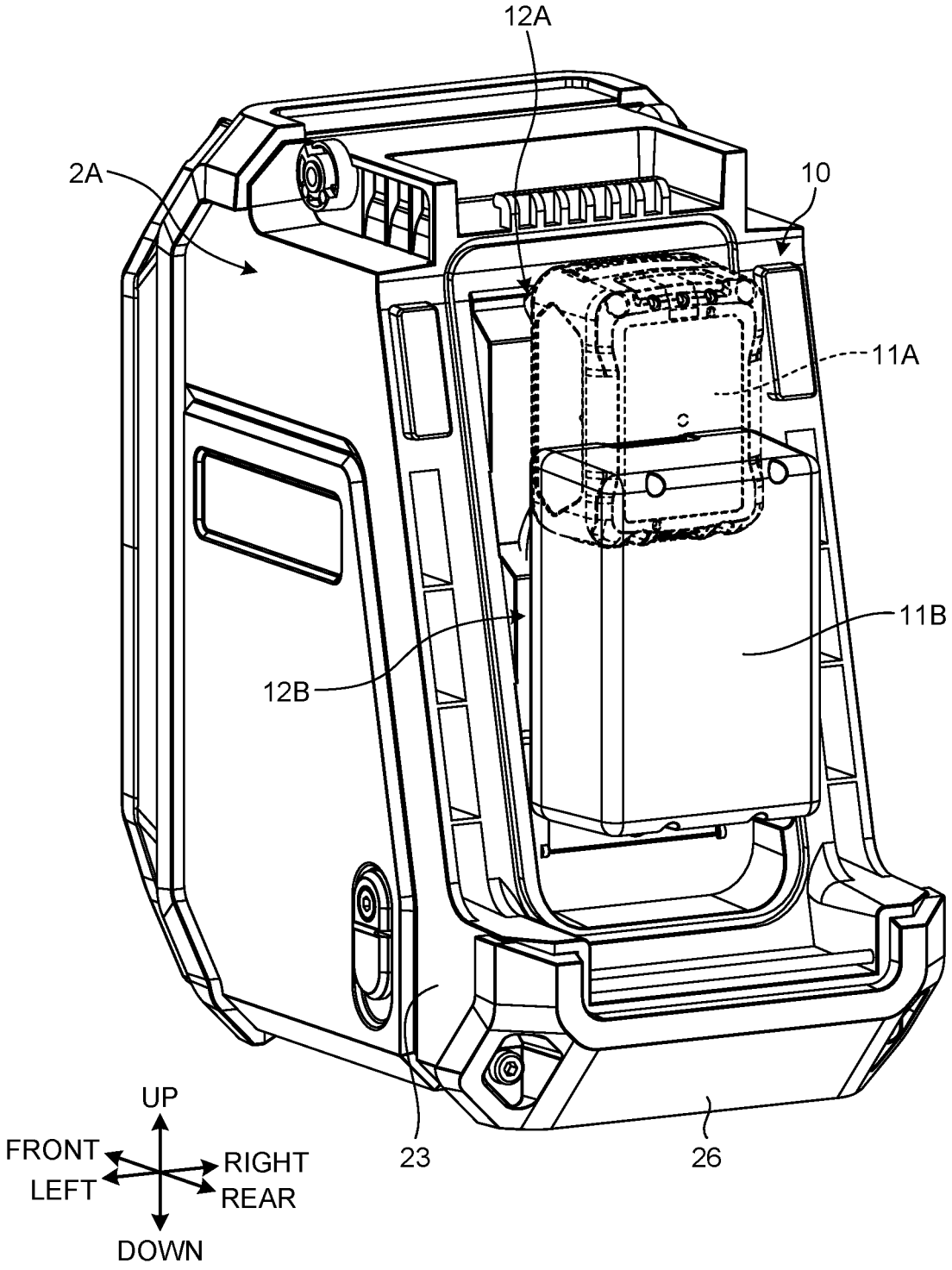
FIG. 11 is a perspective view illustrating the battery housing chamber according to the embodiment.

Next, the following describes the battery housing chamber 10 with reference to FIG. 9, FIG. 10, and FIG. 11. Each of FIG. 9, FIG. 10, and FIG. 11 is a perspective view illustrating the battery housing chamber 10 according to the present embodiment, and illustrates a state in which the lid member 2B is removed from the main body member 2A, and the battery housing chamber 10 is opened.

The battery housing chamber 10 is defined on a rear side of the main body member 2A. The main body member 2A includes battery mounting units 12 on which batteries 11 are mounted. The battery mounting units 12 are disposed on a rear part of the main body member 2A.

The battery 11 is a battery for an electric tool that can supply electric power to an electric tool. The battery 11 is mounted on the battery mounting unit of the electric tool to supply electric power to the electric tool. The battery 11 is a rechargeable battery. The battery 11 includes a secondary battery. When being charged by a charger, the battery 11 holds electric charges. The battery mounting unit 12 of the sound output device 1 has a structure and a function equivalent to those of the battery mounting unit of the electric tool.

In the present embodiment, the batteries 11 that can supply electric power to the sound output device 1 include a first battery 11A and a second battery 11B. An external shape of the first battery 11A is smaller than an external shape of the second battery 11B. By way of example, the first battery 11A is a 10.8V battery, and the second battery 11B is an 18V battery.

The battery mounting units 12 include a first battery mounting unit 12A on which the first battery 11A is mounted, and a second battery mounting unit 12B on which the second battery 11B is mounted. The first battery mounting unit 12A and the second battery mounting unit 12B are disposed in the up-down direction.

In the present embodiment, the battery 11 is a slide-type battery. The battery mounting unit 12 includes a pair of guiding parts that are disposed in the left-right direction to guide the battery 11 in the up-down direction, and a terminal disposed between the pair of guiding parts. The terminal includes a power supply terminal to which electric power is supplied from the battery 11, and a signal terminal for making data communication with the battery 11. The battery 11 is inserted into the guiding parts from above the guiding parts, and slides downward while being guided by the guiding parts so as to be connected to the terminal. The battery 11 may be an insertion-type battery.

FIG. 9 illustrates a state in which the first battery 11A is mounted on the first battery mounting unit 12A. FIG. 10 illustrates a state in which the second battery 11B is mounted on the second battery mounting unit 12B.

In the present embodiment, structures of the battery mounting units 12 and a distance between the two battery mounting units 12 are defined in accordance with external shapes and dimensions of the batteries 11 so that the two batteries 11 (11A, 11B) are not respectively mounted on the two battery mounting units 12 (12A, 12B) at the same time.

As illustrated in FIG. 11, when the second battery 11B is mounted on the second battery mounting unit 12B, for example, if the operator tries to mount the first battery 11A on the first battery mounting unit 12A, the first battery 11A cannot be mounted on the first battery mounting unit 12A because the first battery 11A is in contact with the second battery 11B. Additionally, when the first battery 11A is mounted on the first battery mounting unit 12A, if the operator tries to mount the second battery 11B on the second battery mounting unit 12B, the second battery 11B cannot be mounted on the second battery mounting unit 12B because the first battery 11A is in contact with the second battery 11B.

In this way, in the present embodiment, the structure of each of the first battery mounting unit 12A and the second battery mounting unit 12B, and the distance between the first battery mounting unit 12A and the second battery mounting unit 12B are defined in accordance with the external shape and dimensions of each of the first battery 11A and the second battery 11B so that the second battery 11B is not mounted on the second battery mounting unit 12B when the first battery 11A is mounted on the first battery mounting unit 12A, and the first battery 11A is not mounted on the first battery mounting unit 12A when the second battery 11B is mounted on the second battery mounting unit 12B.

In a case in which an anomaly occurs in at least part of the control board 71 in a state in which the two batteries 11 (11A, 11B) are respectively mounted on the two battery mounting units 12 (12A, 12B) at the same time, a phenomenon in which an electric current flows from the second battery 11B to the first battery 11A may occur. According to the present embodiment, the two batteries 11 (11A, 11B) are not mounted on the respective two battery mounting units 12 (12A, 12B) at the same time, so that occurrence of the phenomenon described above is suppressed.

In the present embodiment, a sealing member is disposed between the main body member 2A and the lid member 2B. In a state in which the main body member 2A is connected with the lid member 2B, and the battery housing chamber 10 is closed, the sealing member prevents foreign substances from entering the battery housing chamber 10 from the external space of the housing 2. The lid member 2B protects the battery mounting unit 12 from foreign substances. The foreign substances include dust and liquid such as rainwater.

Effect

As described above, according to the present embodiment, the tweeters 8 and the woofer 9 are disposed in the sound output device 1 including the battery mounting units 12 on which the batteries 11 for an electric tool are mounted. By adopting the multiway speaker system in which each of the tweeters 8 and the woofer 9 output sounds, the operator can enjoy music or radio broadcasting with high sound quality at a work site. Additionally, even at a work site where an AC power supply is difficult to be used, the operator can enjoy music or radio broadcasting using the sound output device 1 that operates with the battery 11 for an electric tool.

In the present embodiment, at least part of the tweeters 8 is disposed in the internal space SP of the housing 2, and at least part of the woofer 9 is disposed in the internal space SP of the housing 2. The housing 2 prevents foreign substances from entering the internal space SP from the external space of the housing 2. The foreign substances include dust and liquid such as rainwater. Due to this, each of the tweeters 8 and the woofer 9 is protected from the foreign substances by the housing 2.

In a case in which at least part of the tweeters 8 is disposed in the internal space SP of the housing 2, and at least part of the woofer 9 is disposed in the internal space SP of the housing 2, vibrations of air caused by a sound output from the tweeter 8 may propagate to the woofer 9 via the internal space SP, or vibrations of air caused by a sound output from the woofer 9 may propagate to the tweeter 8 via the internal space SP. When vibrations of air propagate from the tweeter 8 to the woofer 9 via the internal space SP, a motion of the woofer 9 may be hindered, and sound quality of the sound output device 1 may be deteriorated. When vibrations of air propagate from the woofer 9 to the tweeter 8 via the internal space SP, a motion of the tweeter 8 may be hindered, and sound quality of the sound output device 1 may be deteriorated. A frequency region of the sound output from the tweeter 8 is different from a frequency region of the sound output from the woofer 9. Thus, when vibrations of air propagate from one speaker of tweeter 8 and the woofer 9 to the other speaker via the internal space SP, sound quality may be deteriorated with high possibility.

According to the present embodiment, the partition member 100 is disposed to partition the internal space SP of the housing 2 into the first space SP1 in which the tweeter 8 is disposed, and the second space SP2 in which the woofer 9 is disposed. When the partition member 100 is disposed, vibrations of air are prevented from propagating from the tweeter 8 to the woofer 9 via the internal space SP, and vibrations of air are prevented from propagating from the woofer 9 to the tweeter 8 via the internal space SP. Due to this, deterioration of sound quality of the sound output device 1 is suppressed.

According to the present embodiment, the partition member 100 is disposed around the tweeter 8 in the internal space SP of the housing 2. The external shape of the tweeter 8 is smaller than the external shape of the woofer 9. When the partition member 100 is disposed around the tweeter 8, the partition member 100 can be downsized.

According to the present embodiment, at least part of the first partition member 101 is disposed in the opening 23M of the left plate 23. At least part of the first tweeter 81 is connected to the first partition member 101. Due to this, the first tweeter 81 is supported by the left plate 23 via the first partition member 101. The same applies to the second partition member 102 and the second tweeter 82.

According to the present embodiment, the first partition member 101 includes the rim part 103 that is disposed in the opening 23M of the left plate 23. The rim part 103 is disposed around the flange part 85F of the first tweeter 81. Due to this, the flange part 85F of the first tweeter 81 is supported by the left plate 23 via the rim part 103 of the first partition member 101. The diaphragm 83 of the first tweeter 81 is disposed inside the opening 23M, so that the sound is smoothly output from the first tweeter 81 to the external space of the housing 2. According to the present embodiment, the first partition member 101 includes the bowl part 104 forming the first space SP1. The bowl part 104 is disposed around the main body part 85B of the first tweeter 81. Due to this, the main body part 85B of the first tweeter 81 is disposed in the first space SP1 that is substantially sealed. Thus, vibrations of air are effectively prevented from propagating from one speaker of the tweeter 8 and the woofer 9 to the other speaker. The first space SP1 is formed of the bowl part 104 including the curved surface. Due to this, strength of the first partition member 101 is maintained. The same applies to the second partition member 102 and the second tweeter 82.

According to the present embodiment, the tweeters 8 include the first tweeter 81 and the second tweeter 82. The first tweeter 81 is disposed on the left plate 23, and the second tweeter 82 is disposed on the right plate 24. By adopting a stereo speaker system in which each of the first tweeter 81 and the second tweeter 82 output sounds, the operator can enjoy music or radio broadcasting with high sound quality at a work site.

The partition member 100 includes the first partition member 101 that is disposed around the first tweeter 81 and supported by the left plate 23 of the housing 2, and the second partition member 102 that is disposed around the second tweeter 82 and supported by the right plate 24 of the housing 2. In the internal space SP, the base part 105 of the first partition member 101 is connected with the base part 105 of the second partition member 102 via the fixing member 130. When the left plate 23 is coupled to the right plate 24 via the partition member 100, rigidity of the housing 2 is improved. Unnecessary vibrations of the housing 2 are suppressed due to improvement in rigidity of the housing 2, so that unnecessary sounds such as boomy sound are prevented from being output.

According to the present embodiment, the partition member 100 is constituted of the first partition member 101 and the second partition member 102, so that good workability can be obtained in manufacture and assembly of the sound output device 1.

According to the present embodiment, the woofer 9 is disposed on the lower plate 22 of the housing 2. Due to this, in a case in which the sound output device 1 is disposed on the disposition surface, the woofer 9 can output a low sound toward a lower side. A gap is formed between the woofer 9 and the disposition surface by the leg parts 7, so that the sound output from the woofer 9 is favorably transmitted to the periphery of the sound output device 1 via the gap.

Other Embodiments

In the embodiment described above, the partition member 100 includes the bowl part 104 surrounding the tweeter 8. The partition member 100 may also include the bowl part 104 surrounding the woofer 9.

In the embodiment described above, the first space SP1 is formed by the bowl part 104 including the curved surface. The first space SP1 is substantially sealed by the bowl part 104. The first space SP1 may be connected with the second space SP2 via an opening provided to part of the bowl part 104. An inner surface of the partition member 100 defining the first space SP1 may include a corner part.

In the embodiment described above, the only one woofer 9 is disposed on the lower plate 22. Two woofers 9 may be disposed on the lower plate 22, or an any number of (three or more) woofers 9 may be disposed. In the left-right direction, it is sufficient that the woofer 9 is disposed between the first tweeter 81 and the second tweeter 82. The woofer 9 may be disposed on the upper plate 21, may be disposed on the front plate 25, or may be disposed on the rear plate 26.

Figure 12:
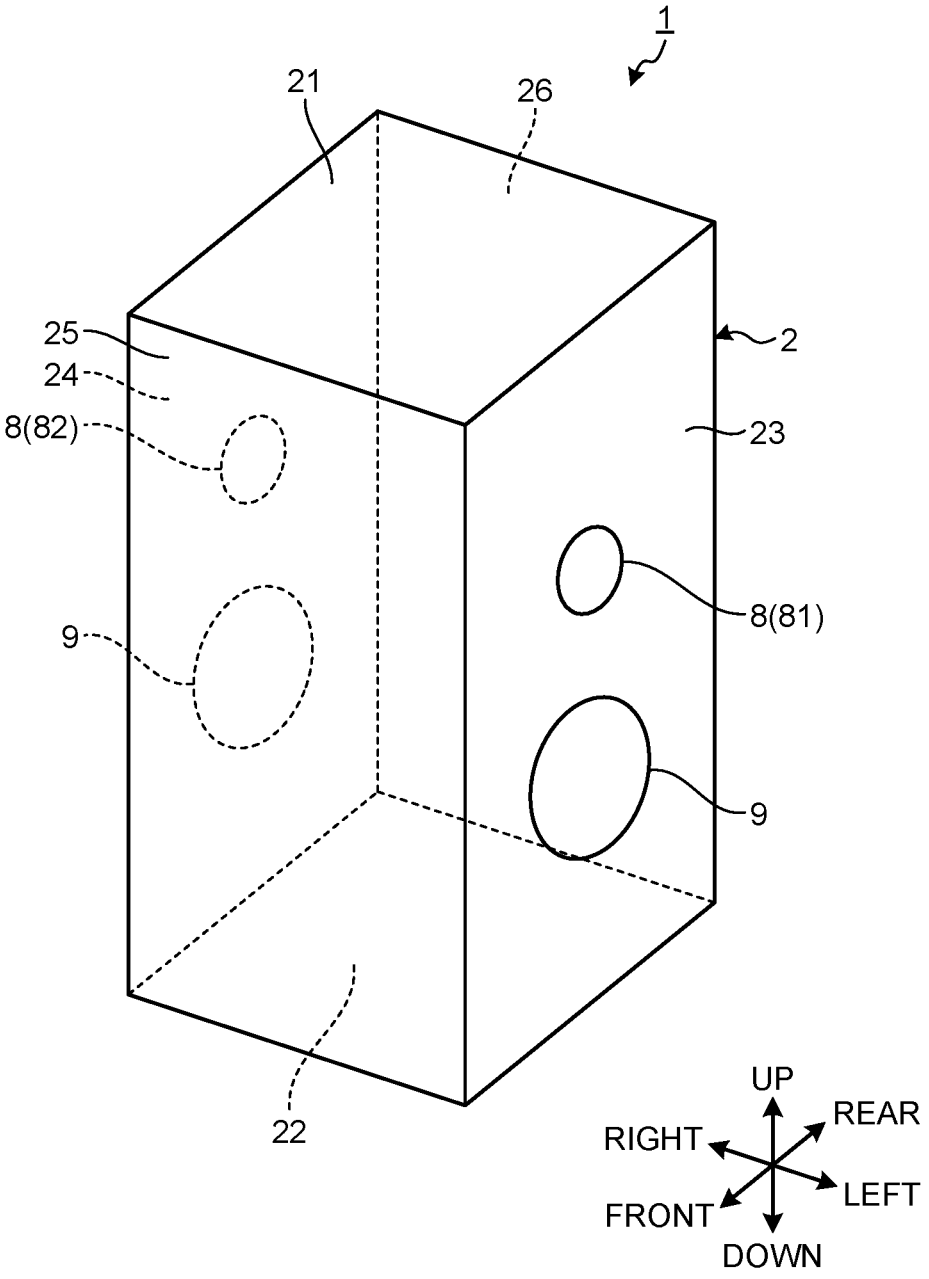
FIG. 12 is a perspective view schematically illustrating the sound output device according to the embodiment.

FIG. 12 is a perspective view schematically illustrating the sound output device 1 according to another embodiment. As illustrated in FIG. 12, the woofers 9 may be disposed on both of the left plate 23 and the right plate 24 of the housing 2. The woofer 9 may be disposed on one of the left plate 23 and the right plate 24 of the housing 2. In a case in which the first tweeter 81 is disposed on the left plate 23 to output a sound toward the left side, the woofer 9 may also be disposed on the left plate 23 to output a sound toward the left side. In a case in which the second tweeter 82 is disposed on the right plate 24 to output a sound toward the right side, the woofer 9 may also be disposed on the right plate 24 to output a sound toward the right side.

In the embodiment described above, two sound output devices 1 may be synchronized with each other to output sounds. For example, sounds may be output from the respective two sound output devices 1 at the same time based on a True Wireless Stereo (TWS) technique.

In the embodiment described above, the structure of the battery mounting unit 12 of the sound output device 1 is equivalent to the structure of the battery mounting unit of the electric tool, and equivalent to the structure of the battery mounting unit of the other sound output device. On the other hand, the structure of the power supply terminal 61 of the sound output device 1 is different from the structures of the power supply terminal disposed in the electric tool, and the power supply terminal of the other sound output device. That is, an AC adapter that can be connected to the power supply terminal of the electric tool or the power supply terminal of the other sound output device cannot be connected to the power supply terminal 61 of the sound output device 1 according to the present embodiment. In other words, only an AC adapter dedicated to the sound output device 1 can be connected to the power supply terminal 61 of the sound output device 1 according to the present embodiment. For example, the length of the power supply terminal 61 may be prolonged to prevent the power supply terminal of the electric tool or the power supply terminal of the other sound output device from being connected to the power supply terminal 61. The AC adapter converts AC power supplied from the AC power supply (commercial power supply) into DC power to be output to the power supply terminal 61. In a case in which an output of the AC adapter of the sound output device 1 according to the present embodiment is large, and a DC power value that can be received by the power supply terminal 61 is large, when another AC adapter is connected to the power supply terminal 61, a phenomenon in which the other AC adapter is heated may occur. In the present embodiment, only the AC adapter dedicated to the sound output device 1 can be connected to the power supply terminal 61, and other AC adapters cannot be connected thereto, so that occurrence of the phenomenon described above is suppressed. The AC adapter dedicated to the sound output device 1 may be connected to the power supply terminal of the electric tool or the power supply terminal of the other sound output device.

In the embodiment described above, the sound output device 1 has the radio broadcasting output function and the music playback function. The sound output device 1 does not necessarily have the radio broadcasting output function, and may have only the music playback function of outputting sound data transmitted from the external apparatus (91, 92). Alternatively, the sound output device 1 does not necessarily have the music playback function, and may have only the radio broadcasting output function.

REFERENCE SIGNS LIST

1 SOUND OUTPUT DEVICE
2 HOUSING
2A MAIN BODY MEMBER
2B LID MEMBER
3 HANDLE
4 BUFFER MEMBER
5 OPERATION PANEL

6 GUARD MEMBER
7 LEG PART
8 TWEETER
9 WOOFER
10 BATTERY HOUSING CHAMBER
11 BATTERY
11A FIRST BATTERY
11B SECOND BATTERY
12 BATTERY MOUNTING UNIT
12A FIRST BATTERY MOUNTING UNIT
12B SECOND BATTERY MOUNTING UNIT
21 UPPER PLATE
22 LOWER PLATE
22M OPENING
23 LEFT PLATE
23M OPENING
24 RIGHT PLATE
24M OPENING
25 FRONT PLATE
26 REAR PLATE
27 LOCK MECHANISM
28 MESH PLATE
31 HOLDING PART
32 ARM PART
35 ANTENNA
41 FIRST TERMINAL
42 SECOND TERMINAL
43 THIRD TERMINAL
45 COVER
46 COVER
47 COVER
51 DISPLAY DEVICE
52 BUTTON
53 BUTTON
54 DIAL
55 EQUALIZER BUTTON
56 INFO BUTTON
57 LIGHT EMITTING UNIT
60 COVER
61 POWER SUPPLY TERMINAL
70 CONTROL DEVICE
70A RECEPTION UNIT
70B COMMUNICATION UNIT
70C ACQUISITION UNIT
70D PROCESSING UNIT
70E OUTPUT UNIT
71 CONTROL BOARD
72 HEAT SINK
81 FIRST TWEETER
82 SECOND TWEETER
83 DIAPHRAGM
84 COIL
85 FRAME
85B MAIN BODY PART
85F FLANGE PART
91 EXTERNAL APPARATUS
92 EXTERNAL APPARATUS
100 PARTITION MEMBER
101 FIRST PARTITION MEMBER
102 SECOND PARTITION MEMBER
103 RIM PART
104 BOWL PART
105 BASE PART
106 PLATE PART
130 FIXING MEMBER
SP INTERNAL SPACE
SP1 FIRST SPACE
SP2 SECOND SPACE

The invention claimed is:

1. A sound output device comprising:
a housing having an internal space;
a battery mounting unit configured to receive and retain a battery for an electric tool;
a tweeter at least part of which is in the internal space;
a woofer at least part of which is in the internal space; and
a partition member that (i) partitions the internal space into a first space in which the tweeter is located and a second space in which the woofer is located and (ii) is configured to prevent vibrations of air propagating between the tweeter and the woofer in the internal space, wherein:
the tweeter includes a first tweeter and a second tweeter configured to direct sound in different directions;
the partition member includes (a) a first partition member that is (i) around the first tweeter and (ii) configured isolate the first tweeter with regard to air vibrations in the internal space and (b) a second partition member that is (i) around the second tweeter and (ii) configured to isolate the second tweeter with regard to air vibrations in the internal space; and
the first partition member and the second partition member are connected in the internal space.

2. The sound output device according to claim 1, wherein
the housing has first and second openings that connect the internal space with an external space of the housing,
at least part of the first partition member is in the first opening,
at least part of the second partition member is in the second opening,
at least part of the first tweeter is connected to the first partition member, and
at least part of the second tweeter is connected to the second partition member.

3. The sound output device according to claim 2, wherein
each of the first and second tweeters includes a diaphragm, a coil, and a frame including a flange part supporting the diaphragm and a main body part around the coil,
each of the first and second partition members includes a rim part in one of the first and second openings and a bowl part forming the first space,
the rim part supports the flange part, and
the bowl part is around the main body part.

4. The sound output device according to claim 3, wherein
the each of the first and second partition members includes a plate part around the rim part, and
the plate part is around the flange part to face an outer surface of the housing.

5. The sound output device according to claim 1, wherein
the first partition member is supported by a left plate of the housing, and
the second partition member is supported by a right plate of the housing.

6. The sound output device according to claim 1, wherein
the woofer is on a lower plate of the housing.

7. The sound output device according to claim 1, wherein
the first tweeter is attached to a left plate of the housing, and
the second tweeter is attached to a right plate of the housing.

8. The sound output device according to claim 1, wherein
the housing includes an upper plate, a lower plate, a left plate, a right plate, a front plate, and a rear plate, the housing includes a main body member and a lid member that is coupled to the main body member in a rotatable manner, the main body member includes a front part of the upper plate, the lower plate, a front part of the left plate, a front part of the right plate, and the front plate, and the lid member includes a rear part of the upper plate, a rear part of the left plate, a rear part of the right plate, and the rear plate.

9. The sound output device according to claim 1, wherein the housing includes a main body member and a lid member that is coupled to the main body member in a rotatable manner, a battery housing chamber is between the main body member and the lid member, the battery housing chamber is opened or closed by rotation of the lid member, and the battery mounting unit is on a rear part of the main body member in the battery housing chamber.

10. The sound output device according to claim 9, wherein the battery mounting unit includes a pair of spaced guiding parts that is configured to guide the battery for an electric tool in an up-down direction when the battery is attached to and detached from the battery mounting unit and a terminal disposed between the guiding parts and the battery mounting unit is configured such that the battery for an electric tool is inserted into the guiding parts from above the guiding parts and slides downward while being guided by the guiding parts so as to be connected to the terminal.

11. The sound output device according to claim 9, wherein the battery mounting unit includes a first battery mounting unit configured to receive and retain a first battery and a second battery mounting unit configured to receive and retain a second battery, and the first battery mounting unit and the second battery mounting unit are configured such that (i) the second battery cannot be mounted on the second battery mounting unit when the first battery is mounted on the first battery mounting unit and (ii) the first battery cannot be mounted on the first battery mounting unit when the second battery is mounted on the second battery mounting unit.

12. A sound output device according to claim 1, comprising:

a housing having an internal space;

a battery mounting unit configured to receive and retain a battery for an electric tool;

a tweeter at least part of which is in the internal space;

a woofer at least part of which is in the internal space; and a partition member that (i) partitions the internal space into a first space in which the tweeter is located and a second space in which the woofer is located and (ii) is configured to prevent vibrations of air propagating between the tweeter and the woofer in the internal space, wherein:

the tweeter includes a first tweeter and a second tweeter, the first tweeter is disposed on a left plate of the housing, and outputs a sound toward a left side of the left plate, the second tweeter is disposed on a right plate of the housing, and outputs a sound toward a right side of the right plate, the partition member includes a first partition member that is disposed around the first tweeter and supported by the left plate, and a second partition member that is disposed around the second tweeter and supported by the right plate, the left plate has a first opening that connects the internal space with an external space of the housing, the right plate has a second opening that connects the internal space with the external space of the housing, the first partition member includes a first rim part that is disposed in the first opening and opens toward a left side, a first bowl part that is disposed in the internal space and forms the first space, a first base part that is fixed to a right part of the first bowl part, and a first plate part that is disposed around the first rim part to face an outer surface of the left plate, the second partition member includes a second rim part that is disposed in the second opening and opens toward a right side, a second bowl part that is disposed in the internal space and forms the first space, a second base part that is fixed to a left part of the second bowl part, and a second plate part that is disposed around the second rim part to face an outer surface of the right plate, and the first base part and the second base part are fixed by a fixing member.

13. The sound output device according to claim 12, wherein a structure and a size of the first tweeter are the same as a structure and a size of the second tweeter, and a center position of the first tweeter coincides with a center position of the second tweeter in each of an up-down direction and a front-rear direction.

14. The sound output device according to claim 12, wherein the woofer is disposed on a lower plate of the housing, the sound output device comprises a leg part that is disposed at part of a periphery of the woofer and projects downward from a lower surface of the lower plate, in a state in which the leg part is in contact with a disposition surface, the woofer is separated from the disposition surface, the woofer outputs a sound toward a side lower than the lower plate, the woofer is disposed between the first tweeter and the second tweeter in a left-right direction, and a center position of the housing coincides with a center position of the woofer in the left-right direction.

* * * * *